US007284603B2

(12) United States Patent
Ohmer

(10) Patent No.: US 7,284,603 B2
(45) Date of Patent: Oct. 23, 2007

(54) EXPANDABLE COMPLETION SYSTEM AND METHOD

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 314 days.

(21) Appl. No.: 10/904,086

(22) Filed: Oct. 22, 2004

(65) Prior Publication Data

US 2005/0077052 A1 Apr. 14, 2005

Related U.S. Application Data

(60) Continuation-in-part of application No. 10/726,892, filed on Dec. 3, 2003, now abandoned, which is a division of application No. 10/078,228, filed on Feb. 19, 2002, now Pat. No. 6,719,064.

(60) Provisional application No. 60/337,788, filed on Nov. 13, 2001.

(51) Int. Cl.
*E21B 23/00* (2006.01)

(52) U.S. Cl. ..... 166/207; 166/233; 166/242.2; 166/384

(58) Field of Classification Search ..... None
See application file for complete search history.

(56) References Cited

U.S. PATENT DOCUMENTS

| | | | | |
|---|---|---|---|---|
| 3,612,627 | A * | 10/1971 | Fuller | 175/325.6 |
| 4,817,716 | A * | 4/1989 | Taylor et al. | 166/277 |
| 5,327,962 | A * | 7/1994 | Head | 277/334 |
| 2003/0075323 | A1 | 4/2003 | Vercaemer et al. | |
| 2003/0089496 | A1 | 5/2003 | Price-Smith et al. | |
| 2003/0146003 | A1 | 8/2003 | Duggan et al. | |
| 2004/0112609 | A1 | 6/2004 | Whanger et al. | |
| 2004/0118572 | A1 | 6/2004 | Whanger et al. | |
| 2004/0123983 | A1 | 7/2004 | Cook et al. | |

FOREIGN PATENT DOCUMENTS

| | | | |
|---|---|---|---|
| WO | WO02/20941 | A1 | 3/2002 |
| WO | WO02/059452 | A1 | 8/2002 |
| WO | WO03/008756 | A1 | 1/2003 |
| WO | WO03/056125 | A2 | 7/2003 |
| WO | WO2004/005669 | A1 | 1/2004 |
| WO | WO2004/018836 | A1 | 3/2004 |

* cited by examiner

*Primary Examiner*—Jennifer H. Gay
*Assistant Examiner*—Angela DiTrani
(74) *Attorney, Agent, or Firm*—Robert Van Someren, P.C.; Dona C. Edwards; Jaime A. Castaño

(57) ABSTRACT

A well completion having an expandable tubular. The expandable tubular having a tubular base and a conforming layer. The conforming layer being radially expandable singularly or in combination with expansion of the tubular base. The expandable tubular being perforated or non-perforated.

29 Claims, 3 Drawing Sheets

EXPANDABLE COMPLETION SYSTEM AND METHOD

RELATED APPLICATIONS

This is a continuation-in-part of U.S. Ser. No. 10/726,892, filed Dec. 3, 2003, now abandoned, which is a divisional of U.S. Ser. No. 10/078,228, filed Feb. 19, 2002, now U.S. Pat. No. 6,719,064 issued Apr. 13, 2004, which claims the benefit under 35 U.S.C. §119(e) to U.S. Provisional Application Ser. No. 60/337,788 filed Nov. 13, 2001.

FIELD OF THE INVENTION

The present invention relates to the field of well completions. More specifically, the invention relates to a system and method for lining a borehole with an expandable tubular.

BACKGROUND

Expandable tubing and sand screens are becoming a viable technology for well completion. Further development of systems and methods improving and broadening the use of the expandable technology are desired.

SUMMARY OF THE INVENTION

In view of the foregoing and other considerations, the present invention relates to well completion systems and more specifically to lining a borehole.

Accordingly, an expandable completion system and method are provided. The completion system includes an expandable tubular. The expandable tubular comprises a tubular base that is radially expandable from an unexpanded state to an expanded state, and a conforming layer connected to the outer surface of the tubular base, wherein the tubular base is expandable from an unexpanded state to an expanded state. The conforming layer may substantially cover the expandable tubular. In a preferred embodiment, the tubular base is corrugated and includes ridges and valleys, the conforming layer being connected within the valleys.

The expandable tubular is adapted for being disposed in a borehole, and open hole section of a well in the unexpanded state. Upon placement, the expandable tubular is radially expanded to an expanded state. In the expanded state the expandable tubular contacts or is positioned proximate the face of the borehole. Thus, the expandable tubular provides support to the borehole face and restricts longitudinal fluid flow through the annulus between the expandable tubular and the borehole face.

The expandable tubular may be expanded to the expanded state by expanding the conforming layer, or by expanding both the conforming layer and the tubular base. The conforming layer may be expandable by chemical intervention or mechanical manipulation. The tubular base may be expandable by mechanical manipulation.

The system of the present invention is adaptable for many situation encountered in a well. For example, it may be desired to line the borehole to prevent fluid communication between the borehole and the formation, and to support the face of the borehole from collapse. In this situation, it may be desired to utilize an expandable tubular that is non-perforated.

In another example, it may be desired to allow fluid communication between the formation and the wellbore, while supporting the borehole face, isolating formation zones and preventing longitudinal fluid flow through the annulus between the expandable tubular and the face of the borehole. Therefore, an expandable tubular having perforations would be utilized. It may be desired to surround each perforation that penetrates the conforming layer with an insert so that the conforming layer, when expanded, does not restrict or prevent flow through the perforation.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
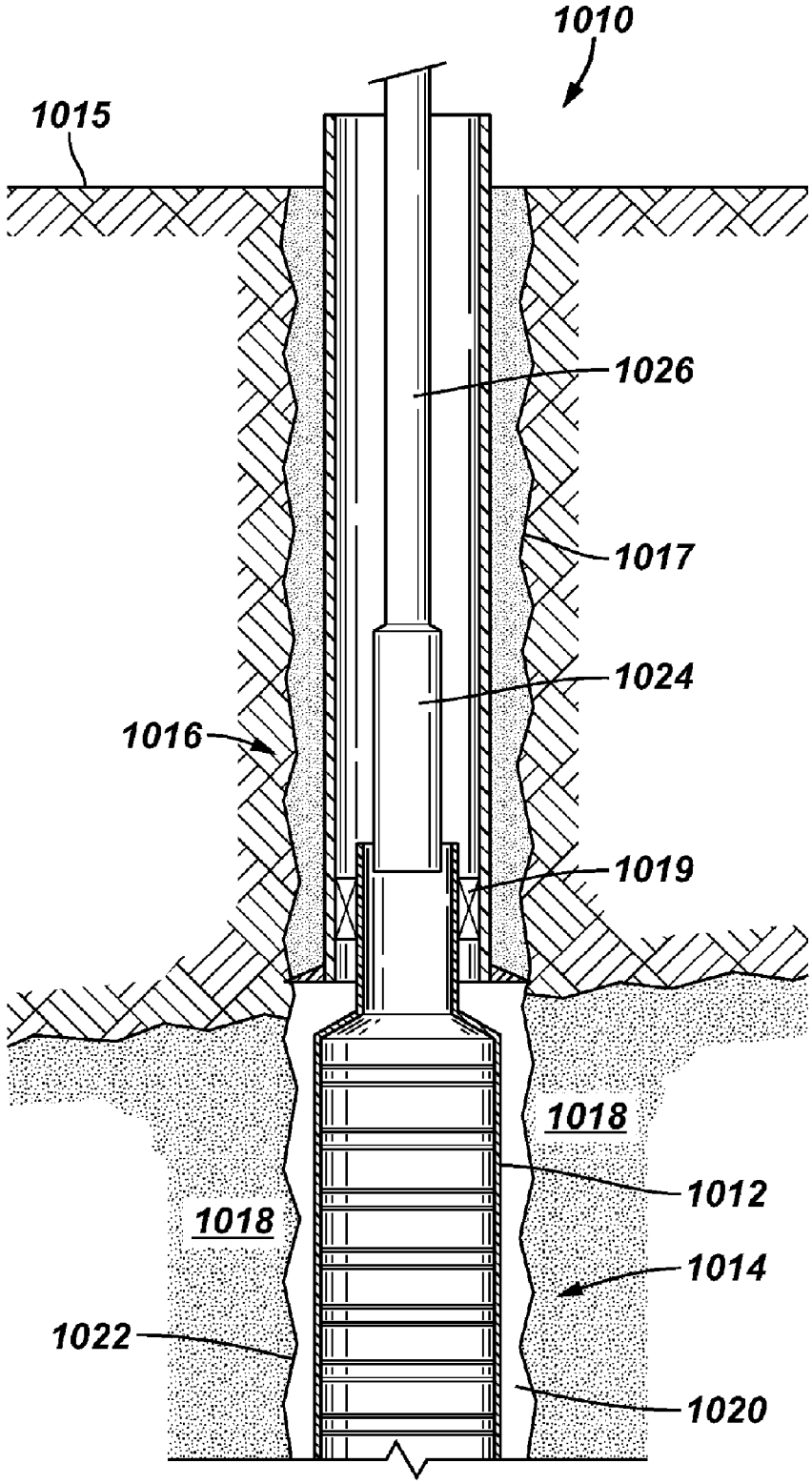
FIG. 1 is a schematic view of an embodiment of the expandable tubular completion system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Note, that the terms "seal" and "isolation" may be used with the recognition that some leakage may occur and that such leakage may be acceptable. Thus, some embodiments of the present invention may allow for leakage without departing from the scope of the invention and systems that allow or provide for such leakage fall within the scope of the invention.

Also, please note, that from time to time tubular elements may be described as liners, casing, or tubing. As well known in the art, the specific identification of tubulars is related to the well application. Therefore, tubular and the related specific identifiers are not intended to limit the scope of the invention. Further, tubulars or other identifies are not limited to a single joint of a tubular but include multiple tubular joints that are interconnected.

It should be further noted that the present invention is applicable for wells in which a fluid is produced from a formation or zone and wells in which it is desired to inject a fluid into a formation. These formations or zones will often be referred to interchangeably as "production formation" and "production zones."

FIG. 1 is a schematic view of an embodiment of the expandable tubular completion system of the present invention, generally designated by the numeral 1010. Expandable tubular completion system 1010 includes an expandable tubular 1012 that is disposed within an open hole section or borehole 1014 of a well. Expandable tubular 1012 may be utilized for multiple purposes including, but not limited to, isolating longitudinal fluid flow between production zones through the annulus between expandable tubular 1012 and borehole 1014, isolating production zones for radial fluid flow between expandable tubular 1012 and formation 1018 and providing radial mechanical support to borehole 1014.

FIG. 1 illustrates a wellbore 1016 formed from a surface 1015 into a formation 1018. Wellbore 1016, includes a cased section 1017 and a borehole 1014. Expandable tubular 1012 is disposed within borehole 1014. Expandable tubular 1012 may be connected to cased section 1017 by mechanisms and methods known in the art, such as hanger 1019. When expandable tubular 1012 is run into borehole 1014 there exists an annulus 1020 formed between the expandable tubular 1012 and borehole 1014, or more specifically to the face 1022 of borehole 1014.

Expandable tubular 1012 may be expanded from its contracted state by various mechanisms as further described hereafter. FIG. 1 shows a deployment device 1024 being run on a string 1026 that may be utilized to expand expandable tubular 1012. Deployment device 1024 may be run in conjunction with other drilling or completion tools.

Figure 2:
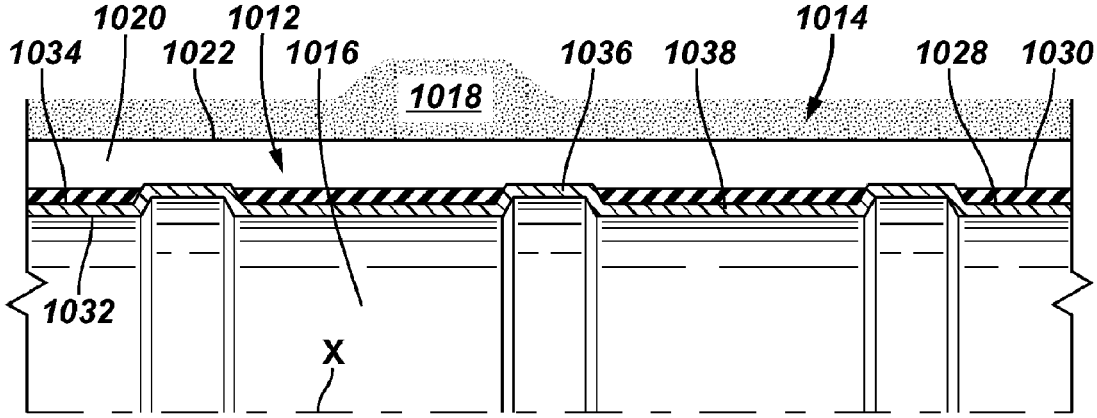
FIG. 2 is a partial, cross-sectional view of an embodiment of a non-perforated expandable tubular of the present invention in the unexpanded state.

FIG. 2 is a partial, cross-sectional view of a non-perforated expandable tubular 1012 of the present invention in the unexpanded state. Expandable tubular 1012 is shown in relation to the longitudinal axis, identified as X, of borehole 1014. When expandable tubular 1012 is in the unexpanded state an annulus 1020 is formed between expandable tubular 1012 and borehole 1014.

Expandable tubular 1012 includes a tubular base 1028. The materials of construction for tubular base 1028 can include those typically used within the oil and gas industry such as carbon steel. They can also be made of specialty alloys (such as a monel, inconel, hastelloy or tungsten-based alloys) if the application requires. Tubular base 1028 has an inner surface 1032 oriented toward longitudinal axis X, and an outer face 1034 oriented toward face 1022 of borehole 1014.

Tubular base 1028 is pre-corrugated, having ridges 1036 and valleys 1038. Ridges 1036 extend outward from tubular base 1028 in relation to longitudinal axis X. The corrugations may be formed in various configurations including circular or helical patterns. Non-perforated expandable tubular 1012 is adapted for lining borehole 1014 and providing radial support to borehole 1014. The corrugated configuration enhances the collapse resistance of expandable tubular 1012 and enhances the ability to support the formation stresses, while minimizing the wall thickness.

Expandable tubular 1012 further includes a conforming layer 1030 connected along outer surface 1034 of tubular base 1028. Conforming layer 1030 is connected between ridges 1036 within the valleys 1038. Conforming layer 1030 is connected to tubular base 1028 by bonding or other mechanisms known in the art.

Conforming layer 1030 is constructed of a special elastomer or polymer. A special elastomer or polymer refers to an elastomer or polymer that undergoes a change when exposed to the wellbore environment or some other chemical or fluid to cause the layer to swell and seal with the wellbore. For example, the elastomer may absorb oil to increase in size or react with some injected chemical to swell and form a seal with the wellbore formation. The special elastomer may react to heat, water, or any method of chemical intervention.

Figure 3:
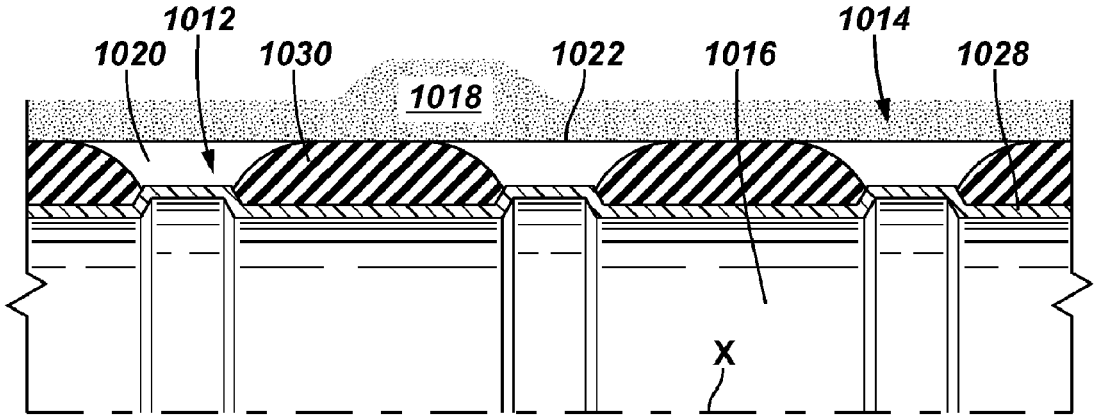
FIG. 3 is a partial, cross-sectional view of an embodiment of a non-perforated expandable tubular of the present invention in the expanded state.

FIG. 3 is a partial, cross-sectional view of a non-perforated expandable tubular 1012 of the present invention in the expanded state. In relation to FIG. 2, conforming layer 1030 has expanded, due to chemical intervention by fluid located in or circulated through annulus 1020, to contact face 1022 of borehole 1014. The expansion of conforming layer 1030 completely or partially seals annulus 1020, providing annular isolation and radial support for borehole 1014.

Figure 4:
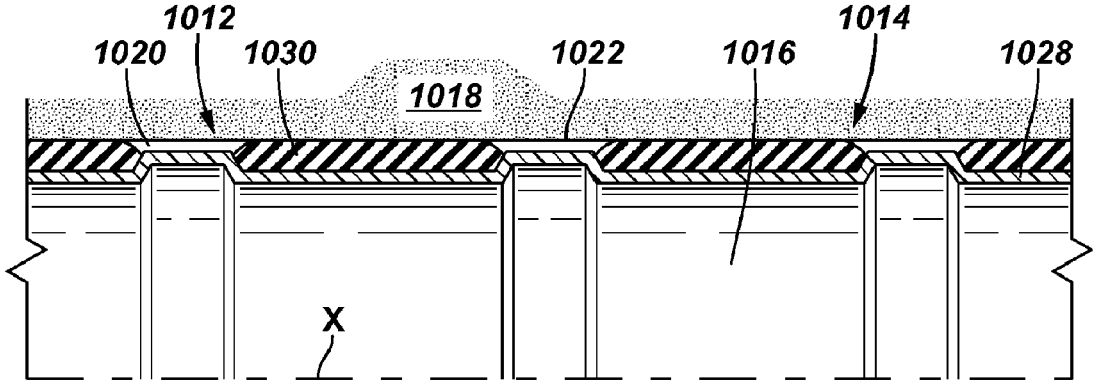
FIG. 4 is a partial, cross-sectional view of an embodiment of a non-perforated expandable tubular in the expanded state.

FIG. 4 is a partial, cross-sectional view of a non-perforated expandable tubular 1012 in the expanded state. This Figure illustrates both conforming layer 1030 and tubular base 1028 radially expanded.

Conforming layer 30 has been expanded radially due to chemical intervention by fluid located, circulated, or momentarily produced through annulus 1020. The expansion of conforming layer 1030 completely or partially seals the annulus, providing annular isolation and radial support for borehole 1014.

Tubular base 1028 has been expanded radially to substantially seal annulus 1020. Outer surface 1034 of tubular base 1028 may contact wellbore face 1022 so that expandable tubular 1012 provides a radial force to support borehole face 1022.

Tubular base 1028 is expanded by deployment device 24 (FIG. 1). Deployment devices can be of numerous types such as, but not limited to, an inflatable packer element, a mechanical packer element, an expandable swage, a piston apparatus, a mechanical actuator, an electrical solenoid, a plug type apparatus, e.g. a conically shaped device pulled or pushed through the tubing, a ball type apparatus or a rotary type expander as further discussed below. Examples of some deployment devices are described in U.S. Pat. No. 6,695,054, which is incorporated by reference herein.

Figure 5:
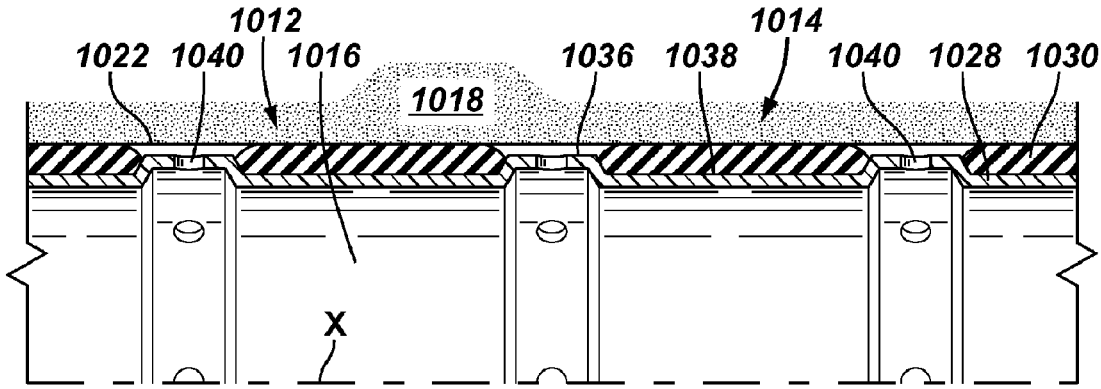
FIG. 5 is a partial, cross-sectional view of an embodiment of a perforated expandable tubular in the expanded state.

FIG. 5 is a partial, cross-sectional view of a perforated expandable tubular 1012 in the expanded state. Expandable tubular 1012 includes perforations 1040 for fluid communication between formation 1018 and expandable tubular 1012. Perforations 1040 are shown formed between sections of conforming layer 1030. Therefore, perforations 1040 are formed through ridges 1036. In this manner, conforming layer 1030 does not expand to seal or block the perforations.

As shown in FIG. 5, both tubular base 1028 and conforming layer 1030 are radially expanded. However, it should be apparent from the description that tubular base 1028 need not be expanded.

Figure 6:
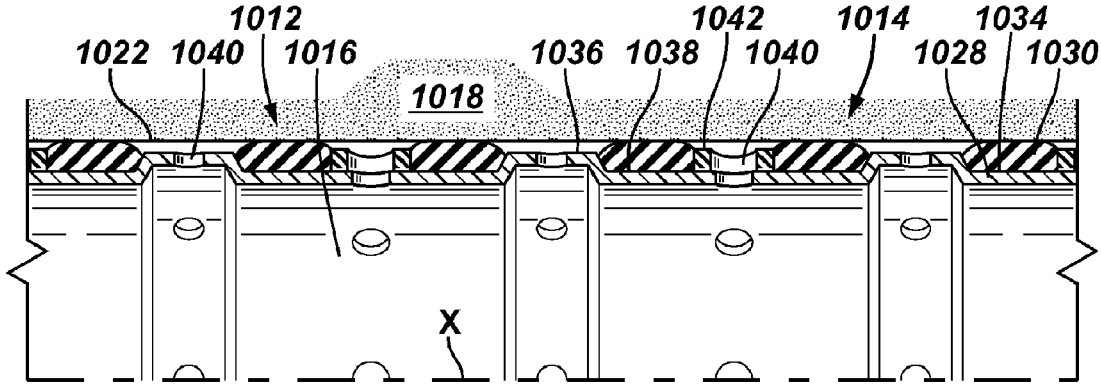
FIG. 6 is a partial, cross-section view of another embodiment of a perforated expandable tubular in the expanded state.

FIG. 6 is a partial, cross-section view of another embodiment of a perforated expandable tubular 1012 in the expanded state. Expandable tubular 1012 forms perforations 1040 through the conforming layer 1030. Additional perforations 1040 may be formed that do not penetrate conforming layer 1030.

Each perforation 1040 that penetrates conforming layer 1030 is surrounded by an insert 1042. Inserts 1042 are constructed of a substantially non-swelling material such as rubber, plastic, ceramic, or metal. Inserts 1042 are connected to outer surface 1034 of tubular base 1028 and/or to conforming layer 1030 in a manner to prevent conforming layer 1030, in the expanded state, from closing perforations 1040 or substantially limiting fluid communication between formation 1018 and expandable tubular 1012 through the perforations.

As shown in FIG. 6, both tubular base 1028 and conforming layer 1030 are radially expanded. However, it should be apparent from the description that tubular base 1028 may not be expanded.

Figure 7:
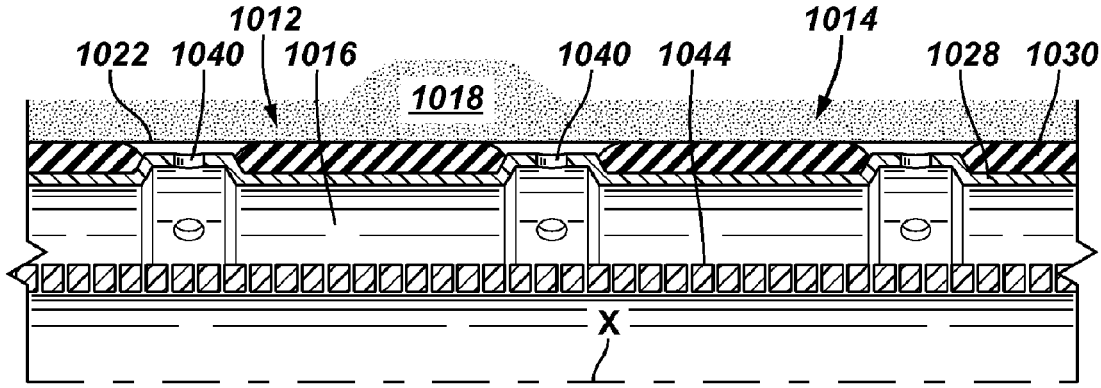
FIG. 7 is a partial, cross-sectional view of another embodiment of the expandable tubular system of the present invention.

FIG. 7 is a partial, cross-sectional view of another embodiment of the expandable tubular system 1010 of the present invention. Expandable tubular 1012 is in the expanded state. Tubular system 1010 further includes a sand screen 1044 disposed within expandable tubular 1012. Sand screen 1044 is run and placed after expansion of tubular base 1028.

With reference to FIGS. 1 through 7, a method of completing a borehole 1014 is described. An expandable tubular 1012 is placed within borehole 1014. If it is desired to line borehole 1014 and not to produce or inject fluid into the adjacent formation 1018 after the well is finally completed, expandable tubular 1012 will not be perforated. If it is desired to produce or inject fluid into formation 1018 adjacent to borehole 1014, expandable tubular 1012 may include preformed perforations or slots 1040. Expandable tubular 1012 is then expanded radially to contact the face 1022 of borehole 1014. Radial expansion of expandable tubular 1012 may include expansion of conforming layer 1030 and/or radial expansion of conforming layer 1030 and tubular base 1028. Activation of conforming layer 1030 to expand is typically by chemical intervention, and/or by mechanical activation, such as by the expansion of tubular base 1028. Tubular base 1028 may be expanded or deployed to the expanded state by deployment tool 1024. Subsequent to expansion of expandable tubular 1012 it may be desired to set a filtering mechanism 1044 within expandable tubular 1012. As a contingency, expandable tubular 1012 may be perforated after installation if communication between formation 1018 and completion bore 1016 is desired. Conversely, pre-perforated sections of expandable tubular 1012 may be later voluntarily obstructed by installing a patch if communication between formation 1018 and completion bore 1016 is no longer desired.

From the foregoing detailed description of specific embodiments of the invention, it should be apparent that a system for lining a borehole that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An expandable tubular, comprising:

a tubular base having an outer surface, the tubular base being formed of a metal material that is radially expandable from an unexpanded state to an expanded state; and a conforming layer connected to the outer surface of the tubular base, the conforming layer being radially expandable from an unexpanded state to an expanded state.

2. The expandable tubular of claim 1, wherein the expandable tubular is non-perforated.

3. The expandable tubular of claim 1, wherein the expandable tubular is perforated.

4. The expandable tubular of claim 3, further including:

an insert disposed about each of the perforations that penetrate the conforming layer in a manner to prevent the conforming layer from restricting the perforations. perforated.

5. The expandable tubular of claim 1, wherein the tubular base is corrugated having ridges separated by valleys.

6. The expandable tubular of claim 5, wherein the conforming layer is disposed in the valleys.

7. The expandable tubular of claim 1, wherein the conforming layer expands radially upon chemical intervention.

8. The expandable tubular of claim 1, wherein the conforming layer expands radially upon mechanical manipulation.

9. A well completion, comprising:

an expandable tubular disposed in a borehole, the expandable tubular comprising:

a corrugated tubular base having ridges and valleys, wherein the tubular base is radially expandable; and a conforming layer attached to an outer surface of the tubular base between the ridges, wherein the conforming layer is radially expandable to contact a face of the borehole, wherein the conforming layer expands radially from the unexpanded state to the expanded state, upon chemical intervention.

10. The completion of claim 9, wherein the conforming layer is radially expanded to contact the face of the borehole.

11. The completion of claim 10, wherein the expandable tubular further includes perforations providing fluid communication between the expandable tubular and a formation adjacent the borehole.

12. The completion of claim 11, wherein the perforations include perforations extending through the tubular base and the conforming layer and further including:

an insert disposed about each perforation that penetrates the conforming layer in manner to prevent the conforming layer from restricting the perforation.

13. A well completion, comprising:

an expandable tubular disposed in a borehole, the expandable tubular comprising:

a corrugated tubular base having ridges and valleys, wherein the tubular base is radially expandable; and a conforming layer attached to an outer surface of the tubular base between the ridges, wherein the conforming layer is radially expandable to contact a face of the borehole, wherein the conforming layer expands radially from an unexpanded state to an expanded state, upon mechanical manipulation.

14. The completion of claim 13, wherein the tubular base is expanded from an unexpanded state.

15. The completion of claim 14, wherein the expandable tubular further includes perforations providing fluid communication between the expandable tubular and a formation adjacent the borehole.

16. The completion of claim 15, wherein the perforations include perforations extending through the tubular base and the conforming layer and further including:

an insert disposed about each perforation that penetrates the conforming layer in manner to prevent the conforming layer from restricting the perforation.

17. The completion of claim 13, wherein:

the conforming layer is radially expanded to contact the face of the borehole; and the tubular base is expanded from an unexpanded state.

18. The completion of claim 17, wherein the expandable tubular further includes perforations providing fluid communication between the expandable tubular and a formation adjacent the borehole.

19. The completion of claim 18, wherein the perforations include perforations extending through the tubular base and the conforming layer and further including:

an insert disposed about each perforation that penetrates the conforming layer in manner to prevent the conforming layer from restricting the perforation.

20. A well completion, comprising:

an expandable tubular disposed in a borehole, the expandable tubular comprising:

a corrugated tubular base having ridges and valleys, wherein the tubular base is radially expandable; and a conforming layer attached to an outer surface of the tubular base between the ridges, wherein the conforming layer is radially expandable to contact a face of the borehole, wherein the expandable tubular further includes perforations providing fluid communication between the expandable tubular and a formation adjacent the borehole.

21. The completion of claim 20, wherein the perforations include perforations only through the tubular base.

22. The completion of claim 20, wherein the perforations include perforations extending through the tubular base and the conforming layer.

23. The completion of claim 22, further including:

an insert disposed about each perforation that penetrates the conforming layer in manner to prevent the conforming layer from restricting the perforation.

24. A method of lining a borehole, the method comprising the steps of:

disposing an expandable tubular in a borehole, the expandable tubular including:

a corrugated tubular base having ridges and valleys; and a conforming layer attached to an outer surface of the tubular base between the ridges;

expanding the expandable tubular radially toward a face of the borehole, wherein the step of expanding the expandable tubular comprises expanding the conforming layer and wherein the conforming layer is expanded by chemical intervention.

25. The method of claim 24, wherein the step of expanding the expandable tubular comprises the step of expanding the tubular base.

26. The method of claim 25, wherein the expandable tubular further includes:

perforations formed therethrough; and an insert disposed about each perforation that penetrates the conforming layer in manner to prevent the conforming layer from restricting the perforation.

27. The method of claim 24, wherein the expandable tubular further includes:

perforations formed therethrough; and an insert disposed about each perforation that penetrates the conforming layer in manner to prevent the conforming layer from restricting the perforation.

28. A method of lining a borehole, the method comprising the steps of:

disposing an expandable tubular in a borehole, the expandable tubular including:

a corrugated tubular base having ridges and valleys; and a conforming layer attached to an outer surface of the tubular base between the ridges;

expanding the expandable tubular radially toward a face of the borehole, wherein the expandable tubular further includes:

perforations formed therethrough.

29. The method of claim 28, wherein the expandable tubular further includes:

an insert disposed about each perforation that penetrates the conforming layer in manner to prevent the conforming layer from restricting the perforation.

* * * * *